US005909161A

United States Patent [19]

DiMarco et al.

[11] Patent Number: 5,909,161

[45] Date of Patent: Jun. 1, 1999

[54] INTERMEDIATE LATCH FOR A MOLDED CASE CIRCUIT BREAKER

[75] Inventors: Bernard DiMarco, Lilburn; Neal Reeves, Atlanta; Robert E. Black, Snellville, all of Ga.

[73] Assignee: Siemens Energy & Automation, Alpharetta, Ga.

[21] Appl. No.: 08/988,094

[22] Filed: Dec. 10, 1997

[51] Int. Cl.[6] ..... H01H 9/20

[52] U.S. Cl. ..... 335/21; 335/6; 335/8; 335/10; 335/42; 335/45; 335/167; 335/171; 335/172

[58] Field of Search ..... 335/6, 8, 9, 10, 335/21, 23, 35, 38, 42, 43, 45, 167, 171, 172; 200/318, 323, 324, 325

[56] References Cited

U.S. PATENT DOCUMENTS

| | | | |
|---|---|---|---|
| 4,528,531 | 7/1985 | Flick et al. | 335/23 |
| 4,609,799 | 9/1986 | Ohishi et al. | 200/153 G |
| 4,906,967 | 3/1990 | Winter | 335/172 |
| 5,369,384 | 11/1994 | Heins | 335/171 |
| 5,440,088 | 8/1995 | Coudert et al. | 200/303 |
| 5,444,423 | 8/1995 | Venzke et al. | 335/167 |

*Primary Examiner*—Michael L. Gellner
*Assistant Examiner*—Raymond Barrera

[57] ABSTRACT

A molded case circuit breaker includes a generally "Z" shaped intermediate latch structure which has upper and lower substantially planar sections that are each bent at an angle with respect to a center pivot section. The upper portion of the intermediate latch includes one or two latch surfaces. One of these latch surfaces engages the cradle of the operating mechanism of the circuit breaker, to latch the operating mechanism when the circuit breaker is closed. The other latch surface engages a trip bar or an intermediate latch bar, which is rotated by the trip unit when an overcurrent condition occurs. The lower portion of the intermediate latch structure also includes a latch surface which may engage a trip bar. This latch surface is sloped such that when the latch surface of the trip bar is moved along this sloped latch surface, the trip bar rotates. This rotation of the trip bar adjusts the spacing between the trip bar and a bimetallic strip or magnetic armature of a thermal and magnetic trip unit to allow the rating of the circuit breaker to be changed in the field. The pivot portion of the intermediate latch structure includes two mounting tabs, one on either side of the latch. The mounting tabs have a generally rectangular cross-section and, due to the angled relationship between the pivot portion and the upper and lower portions of the intermediate latch, the latch pivots on an edge of the mounting tabs. This edge is aligned with an angular opening in the mechanical frame to mount the intermediate latch. The mounting tabs also retain a biasing spring which biases the intermediate latch toward the cradle and biases the trip bar or latch bar toward the intermediate latch.

14 Claims, 11 Drawing Sheets

INTERMEDIATE LATCH FOR A MOLDED CASE CIRCUIT BREAKER

FIELD OF THE INVENTION

The present invention relates generally to a molded case circuit breaker and more particularly to the structure of the operating mechanism which controls the mechanical operation of the circuit breaker.

BACKGROUND OF THE INVENTION

Molded case circuit breakers are well known in the art. The principal components of a molded case circuit breaker are a movable upper contact arm and a movable or stationary lower contact arm. When the circuit breaker is closed, the upper contact arm is in electrical contact with the lower contact arm to allow current to flow through the circuit breaker. The operating mechanism of a typical circuit breaker is designed to protect an electrical system, coupled to the circuit breaker from high level overcurrent conditions, requiring high speed tripping and longer duration low-level overload conditions by separating the upper contact arm from the lower contact arm to open the circuit breaker. Typically, the contact arms of a molded case circuit breaker are opened and closed by an overcenter toggle mechanism. When the contacts of the circuit breaker are closed, this toggle mechanism is latched such that when the latch is released the toggle mechanism causes the upper contact arm to quickly move away from the lower contact arm, opening the circuit breaker.

The latch of a typical toggle mechanism is positioned adjacent to a trip bar which, when engaged, opens the latch, causing the electrical contact arms to open. The trip bar is typically engaged by apparatus such as a bimetallic element which bends in response to an overcurrent condition and, in so bending, causes the trip bar to rotate and release the latch. Prior art circuit breakers have also included an armature which is responsive to the magnetic field generated by current flowing through the breaker to engage the trip bar.

The overcenter toggle mechanism and the trip mechanism are relatively complex structures. As the features provided in molded case circuit breakers increase, the complexity of the operating mechanisms also tends to increase. This increasing complexity may make it difficult to produce a circuit breaker which opens consistently responsive to the same force applied to the trip bar. This inconsistency in the operation of the circuit breaker results from uncertainty in the position of the various components of the operating mechanism and trip mechanism. Because of this inconsistency in the operation of the circuit breaker, it may be difficult to produce a molded case circuit breaker which accurately conforms to a predetermined rating or which is difficult to calibrate.

SUMMARY OF THE INVENTION

The present invention is embodied in a molded case circuit breaker having a simplified operating mechanism. The operating mechanism includes an intermediate latch plate having a generally "Z" shape. The shape of the intermediate latch defines an upper portion on the first leg of the "Z" a pivot portion on the connecting bar of the "Z" and a bottom portion on the second leg of the "Z". The pivot portion of the intermediate latch defines an edge on which the latch pivots. The positioning of the pivot mechanism on the connecting bar of the "Z" allows the latch to be positioned in the circuit breaker with great accuracy.

According to one aspect of the invention, the lower portion of the intermediate latch includes a latch surface which engages the trip bar and the upper portion of the intermediate latch includes a latch surface that engages the operating mechanism of the circuit breaker. The lower latch surface is angled in a direction along which the trip bar may be moved. The trip bar is moved along this latch surface to adjust the distance between the trip bar and the bimetallic element, thus adjusting the rating of the circuit breaker.

According to another aspect of the invention, the pivot mechanism of the intermediate latch structure retains a torsion spring which biases the intermediate latch toward the operating mechanism of the breaker while at the same time biasing the trip bar into a position which engages the lower latch surface of the intermediate latch.

According to yet another aspect of the invention, the intermediate latch includes a secondary trip latch surface on the upper portion of the intermediate latch.

DETAILED DESCRIPTION

Figure 1:
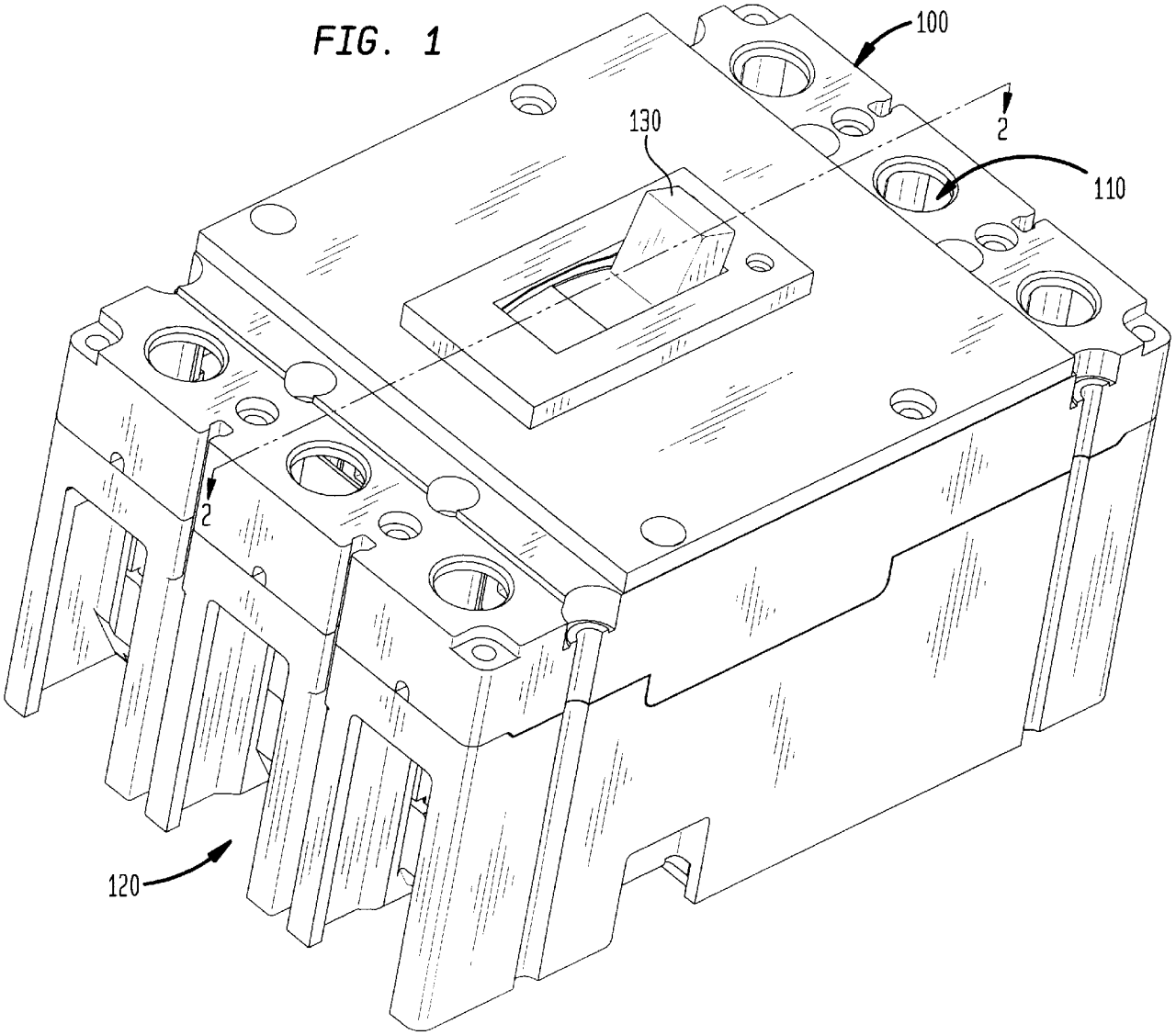
FIG. 1 is an isometric drawing of a circuit breaker which includes an operating mechanism according to the present invention.

FIG. 1 is an isometric drawing of a circuit breaker 100 which includes an embodiment of the present invention. The circuit breaker shown in FIG. 1 is a multi-component molded case circuit breaker having line terminals 110, load terminals 120, and a toggle handle 130 that controls the operating mechanism of the circuit breaker to manually open and close the circuit breaker contacts. The exemplary circuit breaker 100 is a three-pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although the present invention is described in the context of a three-phase circuit breaker, it is contemplated that it may be practiced in a single-phase circuit breaker or in other multi-phase circuit breakers.

Figure 2:
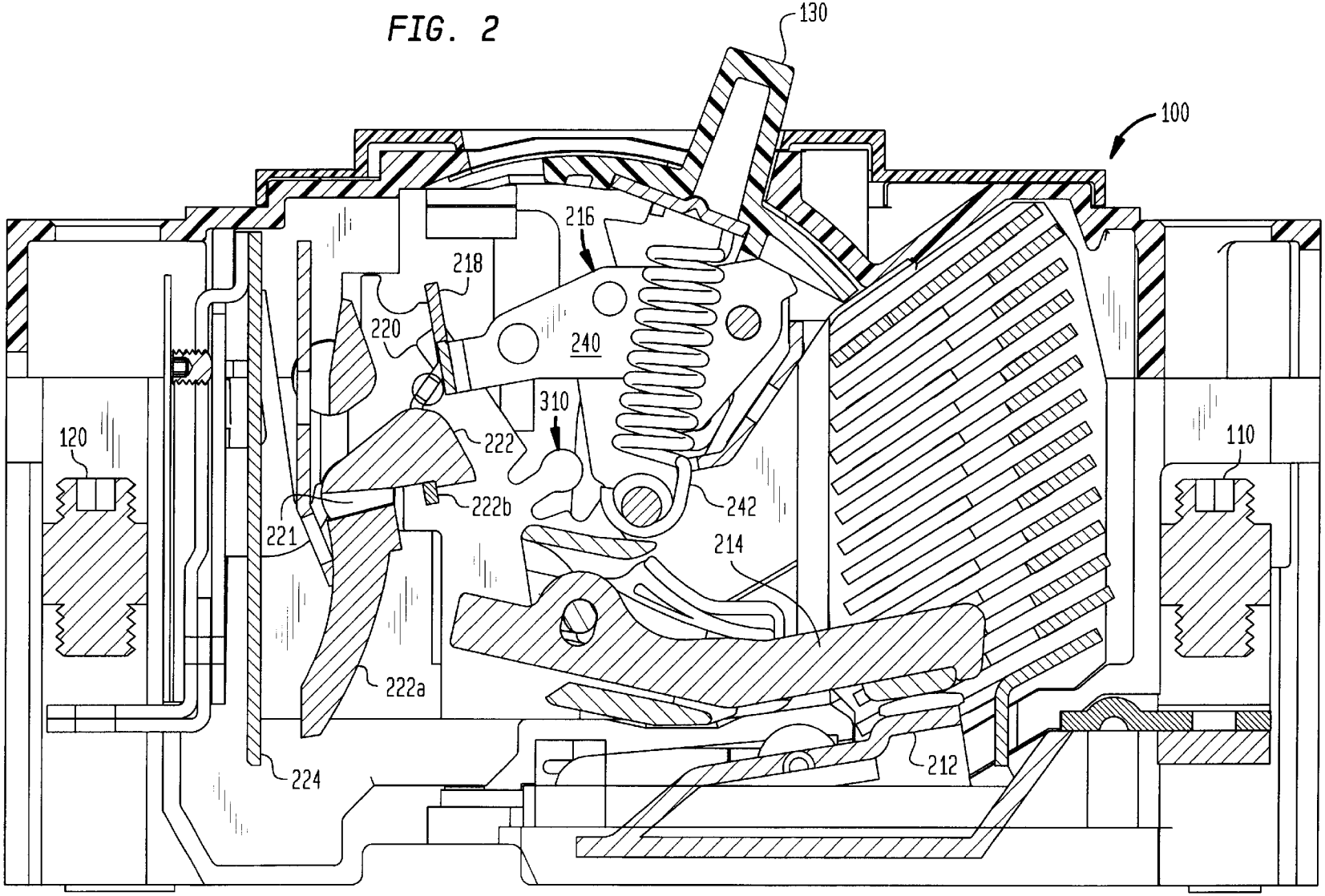
FIG. 2 is a cutaway view of the circuit breaker shown in FIG. 1 along the lines 2—2 which is useful for describing the operation of the circuit breaker shown in FIG. 1.

FIG. 2 is a cutaway view of the circuit breaker 100 along the lines 2—2 shown in FIG. 1. As shown in FIG. 2, the main components of the circuit breaker are a fixed line contact arm 212 and a movable load contact arm 214. The load contact arms for each of the three phases of the breaker are mechanically connected together by an insulating crossbar member 230. This crossbar member 230, in turn, is mechanically coupled to the overcenter mechanism so that, by moving the toggle handle 130 from left to right, the crossbar 230 rotates in a clockwise direction and all three load contact arms 214 are concurrently moved to engage their corresponding line contact arms 212.

The overcenter mechanism 240 includes a cradle 216 which engages an intermediate latch 218, as described below to hold the contacts of the circuit breaker in a closed position unless and until an overcurrent condition occurs which causes the circuit breaker to trip.

The exemplary intermediate latch 218 is generally "Z" shaped having an upper leg which includes a latch surface (not shown in FIG. 2) that engages the cradle 216, and a lower leg having a latch surface (not shown in FIG. 2) which engages a trip bar 222. The center portion of the "Z" shaped intermediate latch element 218 is angled with respect to the upper and lower legs and includes two tabs which provide a pivot edge for the intermediate latch 218 when it is inserted into the mechanical frame 310. As shown in FIG. 2, the intermediate latch 218 is coupled to a torsion spring 220, which is retained in the mechanical frame by the mounting tabs of the intermediate latch 218. The spring 220 biases the upper latch surface of the intermediate latch 218 toward the cradle 240 while at the same time biasing the trip bar 222 into a position which engages the lower latch surface of the intermediate latch 218.

The trip bar 222 pivots in a counterclockwise direction about an axis 221 responsive to a force exerted by a bimetallic element 224 during, for example, a long duration overcurrent condition. As the trip bar 222 rotates in a counterclockwise direction, a latch surface 222*b* on the upper portion of the trip bar disengages the latch surface on the lower portion of the intermediate latch 218. When this latch surface of the intermediate latch 218 is disengaged, the intermediate latch 218 rotates in a counterclockwise direction under the force of the operating mechanism 240, exerted through the cradle 216. In the exemplary circuit breaker, this force is provided by a tension spring 242. Tension is applied to the spring when the breaker toggle handle 130 is moved from the open position to the closed position.

As the intermediate latch 218 rotates responsive to the upward force exerted by the cradle 216, it releases the latch on the operating mechanism 240, allowing the cradle 216, to rotate in a clockwise direction. When the cradle 216 rotates, the operating mechanism 240 is released and the crossbar 230 rotates in a counterclockwise direction to move the load contact arms 214 away from the line contact arms 212.

During normal operation of the circuit breaker, current flows from the line terminal 110 through the line contact arm 212 to the load contact arm 214. From the load contact arm 214, the current flows to the bimetallic element 224 through a flexible conductor (shown in FIG. 3) and from the bimetallic element 224 to the load terminal 120. When the current flowing through the circuit breaker exceeds the rated current for the breaker, it heats the bimetallic element 224, causing the element 224 to bend toward the trip bar 222. If the overcurrent condition persists, the bimetallic element 224 bends sufficiently to engage the trip bar surface 222*a*. As the bimetallic element engages the trip bar surface 222*a* and continues to bend, it causes the trip bar to rotate in a counterclockwise direction releasing the intermediate latch 218 and thus unlatching the operating mechanism 240 of the circuit breaker.

Figure 3:
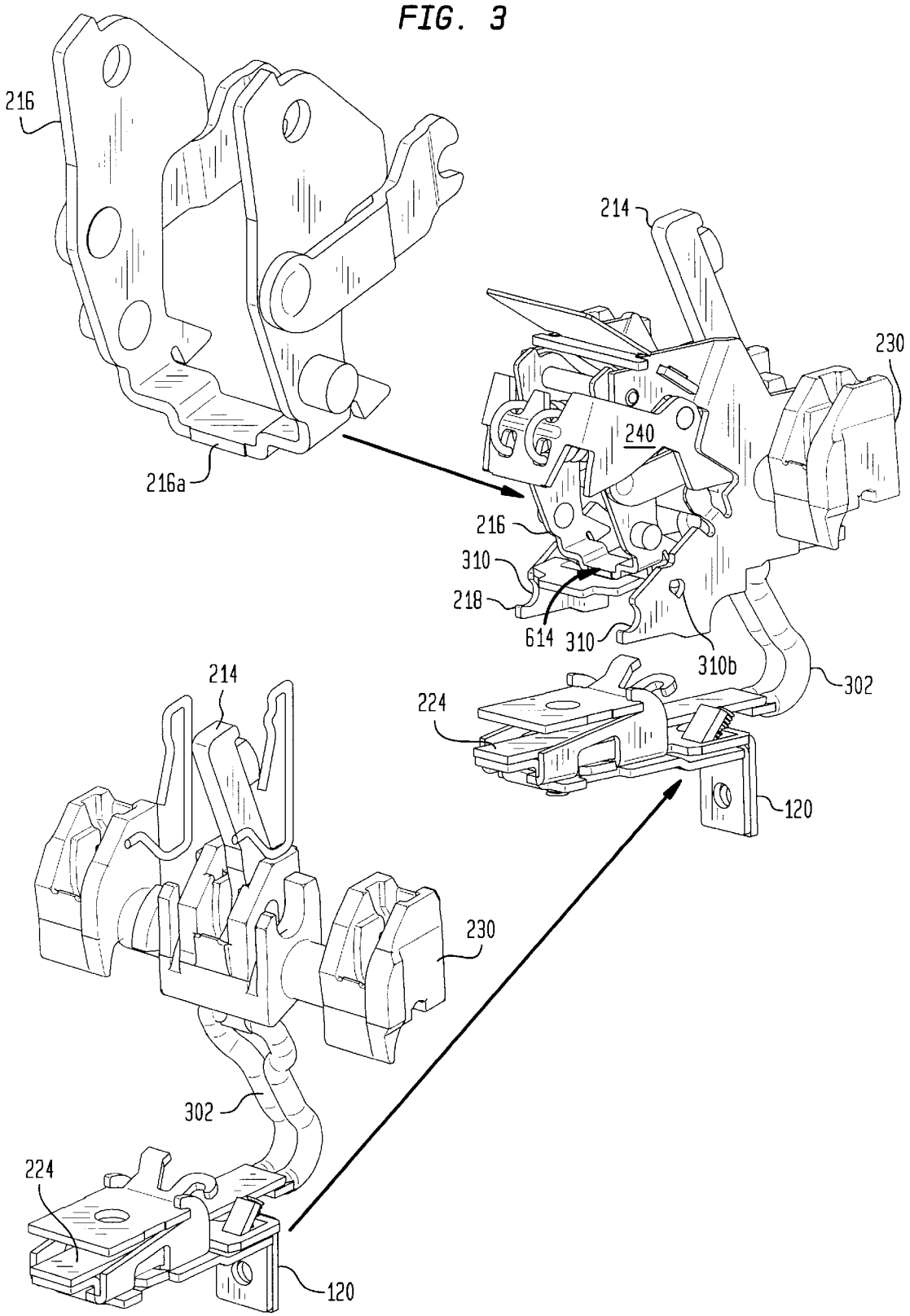
FIG. 3 is an exploded isometric drawing of the operating mechanism and contact structure of the circuit breaker shown in FIG. 1 which is useful for describing the operation of the subject invention.

FIG. 3 is an exploded isometric drawing which illustrates the construction of a portion of the circuit breaker shown in FIG. 2. In FIG. 3, only the load contact arm 214 of the center pole of the circuit breaker is shown. This load contact arm as well as is the contact arms for the other two poles, are fixed in position in the crossbar element 230. The load contact arm 214 is coupled to the bimetallic element 224 by a flexible conductor 302. As shown in FIG. 3, current flows from the flexible conductor 302 through the bimetallic element 224 to a connection at the top of the bimetallic element 224 which couples the current to the load terminal 120.

In the exemplary circuit breaker 100, the crossbar 230 is coupled to the operating mechanism 240, which is held in place in the base of the molded case circuit breaker 110 by a mechanical frame 310. A key element of the operating mechanism 240 is the cradle 216. As shown in FIG. 3, the cradle 216 includes a latch surface 216*a* which engages the upper latch surface 614 in the intermediate latch 218. The intermediate latch 218 is held in place by its mounting tabs which extend through respective openings 310*b* on either side of the mechanical frame 310.

Figure 4A:
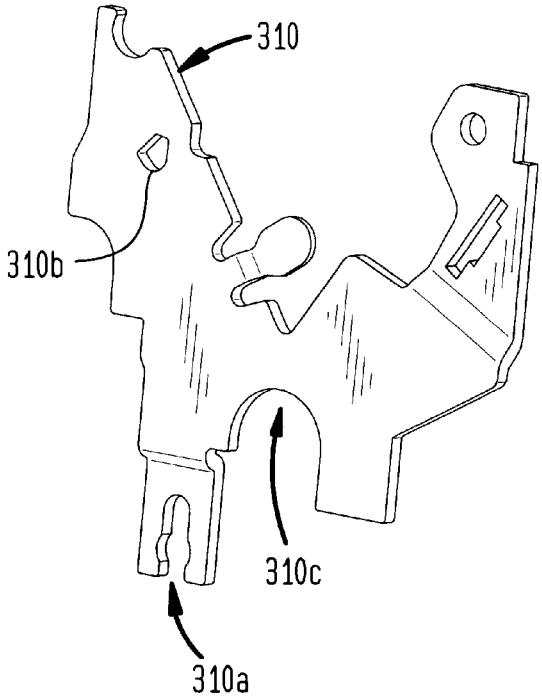
FIG. 4A is an isometric drawing of one side element of a mechanical frame which holds the operating mechanism of the circuit breaker shown in FIGS. 1 and 2.
Figure 4B:
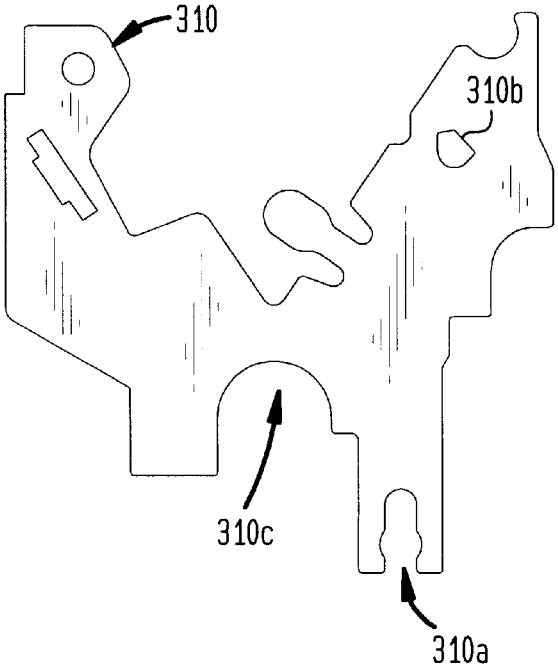
FIGS. 4B and 4C, respectively, are a side plan view and an end plan view of the other side of the mechanical frame structure shown in FIG. 4A.
Figure 4C:
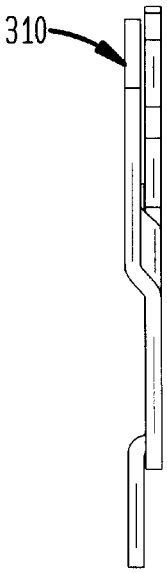
Figure 4D:
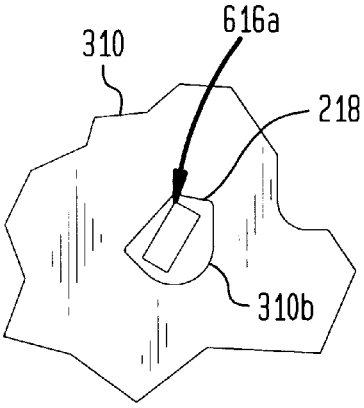
FIG. 4D is a side plan view showing details of a portion of the mechanical frame structure shown in FIG. 4B.

FIG. 4A shows the one side member 310 and FIGS. 4B and 4C show the other side member 310 of the mechanical frame. FIG. 4D illustrates a detail found on both sides 130 of the mechanical frame. In the exemplary embodiment of the invention, the two side members 130 of the mechanical frame support the operating mechanism of the circuit breaker and retain the operating mechanism in the base of the circuit breaker 100.

FIG. 4A is an isometric drawing of one side 310 of the mechanical frame. The mechanical frame side 310 is held into the base of the circuit breaker 100 by a mounting tab 310A. Symmetric openings 310*b* on either side ofthe mechanical frame 310 engage the mounting tabs of the intermediate latch 218, as described below with reference to FIG. 4D. The mechanical frame side 310 also includes a semi-circular opening 310C which forms an upper bearing surface for the crossbar mechanism 230.

FIG. 4D shows a portion of the mechanical frame side 310 which surrounds the opening 310*b* that forms the pivot point for the intermediate latch 218. The mounting tab 616 (shown in FIG. 6) of the intermediate latch 218 is illustrated in its latched position in the opening 310*b*. As shown in FIG. 4D, the opening 310*b* in the mechanical frame side 310 has a generally "U" shaped bottom part and an upper part defined by two intersecting straight edges. The edges intersect to form a corner which defines the pivot point for the intermediate latch 218. As described above, with reference to FIG. 2, the intermediate latch 218 is held in the latched position by an upwards force exerted on a latch surface of the latch 218 by the cradle 216. This force tends to push the intermediate latch toward the upper surface of the opening 310*b* in the mechanical frame side 310. Because the mounting tabs 616 of the latch 218 have a rectangular cross section, they include a pivot edge 616*a* which, when the latch is loaded, engages the pivot point defined by the intersecting top edges of the opening 310*b* in the side 310 of the mechanical frame. In addition, because the mounting tab 616 is at an angle with respect to the upper and lower latch surfaces of the intermediate latch 218, the intermediate latch 218 pivots on the edge 616*a* of the rectangular cross section. This structure provides an advantage for the exemplary intermediate latch structure because the pivot point of the latch 218 in the mechanical frame is well defined and thus, the position of the intermediate latch 218 when the operating mechanism is engaged is certain and not subject to variability. In addition, the force exerted by the latch on the trip bar is more consistent, improving the reliability of the circuit breaker.

If for example, the intermediate latch and the opening in the mechanical frame 310 were designed such that the latch pivoted on the upper flat surface of the mounting tab 616, the position of the latch when the operating mechanism was engaged may be less certain. For example the latch rather than resting on the flat surface could be resting on one edge or the other. This variability and possible pivot positions, would introduce an uncertainty into the design which would affect the accuracy of the current rating for the circuit breaker. This variability in the position of the latch pivot may also change the force that must be exerted by the bimetallic element to trip the breaker and, thus, make the circuit breaker more difficult to calibrate.

Because the position of the intermediate latch is well defined when the operating mechanism of the circuit breaker is in the closed position, the intermediate latch may be used, as described below, to adjust the spacing between the trip bar 222 and the bimetallic element 224 and, thus, to adjust the current rating of the circuit breaker.

Figure 5:
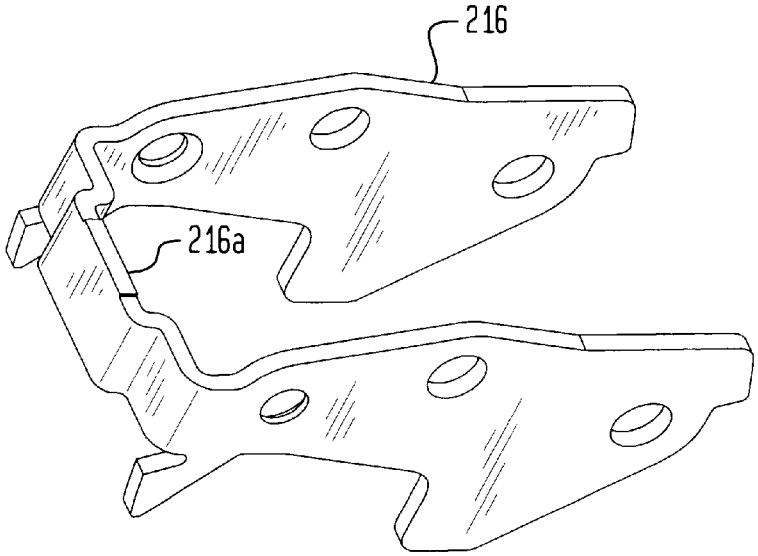
FIG. 5 is an isometric drawing of a cradle structure suitable for use with the operating mechanism of the present invention.
Figure 6A:
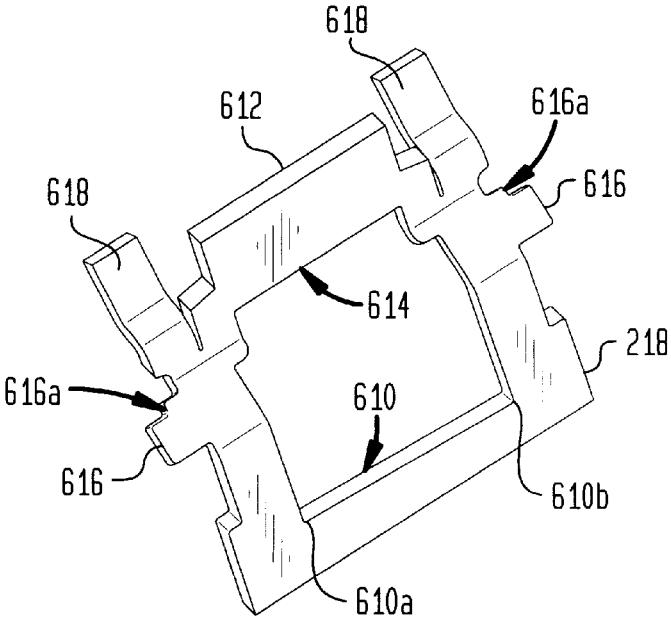
FIG. 6A is an isometric drawing of an intermediate latch according to the present invention.
Figure 6C:
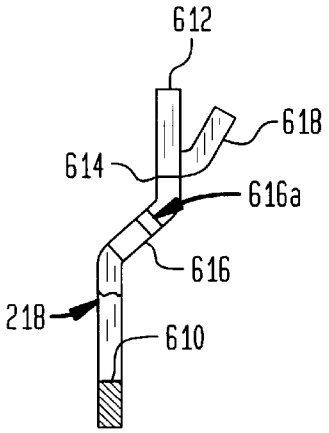
FIGS. 6B and 6C, respectively, are a side plan view and an end plan view of the latch structure shown in FIG. 6A.
Figure 6B:
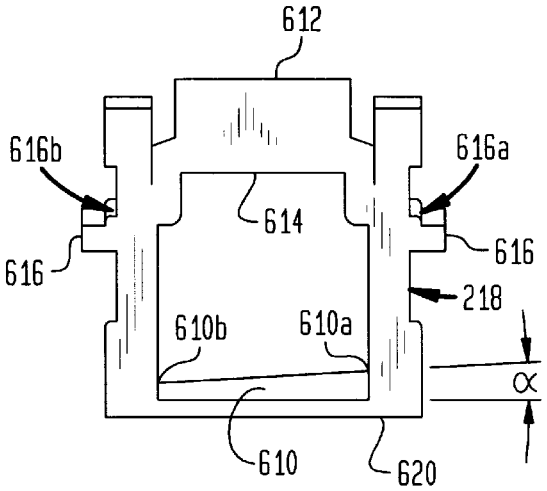

FIG. 5 is an isometric drawing for the cradle assembly 216 used in the operating mechanism 240 of the circuit breaker shown in FIG. 2. The cradle assembly 216 includes a latch surface 216*a* which engages the latch surface 614 (shown in FIG. 6) of the intermediate latch 218 when the circuit breaker is in a closed position. As described above with reference to FIG. 2, when the latch 218 is released and rotates in a counterclockwise direction, the cradle 240 rotates in a clockwise direction responsive to a force exerted by the tension spring 242. FIGS. 6A, 6B and 6C are various view of the intermediate latch 218. As shown in FIG. 6A, the intermediate latch 218 includes an upper latch surface 614 and a lower latch surface 610. The upper latch surface 614 engages latch surface 216*a* on the cradle 216. The lower latch surface 610 engages latch surface 222*b* of the trip bar 222. The intermediate latch 218 also includes two tabs 618 which extend from the upper portion of the intermediate latch and which are bent away from upper portion of the latch in a clockwise direction. As described below, these tabs are used to retain the ends of the torsion spring 220 which biases the intermediate latch toward the cradle 216.

As shown in FIG. 6A, the lower latch surface is slanted across the intermediate latch 218, from one side to the other; the latch surface at point 610*a* is higher than the surface at point 610*b* on the latch surface 610. This configuration of the latch surface 610 allows the current rating of the circuit breaker to be adjusted by sliding the latch surface 222*b* of the trip bar 222 across the latch surface 610 of the intermediate latch 218. Referring to FIG. 2, this sliding of the latch surface 222*b* may be accomplished using an adjustment knob (not shown) which moves the trip bar 222 into and out of the page as shown in FIG. 2.

When the position of the trip bar is adjusted so that the trip bar is the farthest into the page as shown in FIG. 2, the trip bar 222 is rotated counterclockwise from the position shown in FIG. 2. In this position, the trip surface 222*a* of the trip bar is positioned farther from the bimetallic element 224. Thus, a greater deflection of the bimetallic element 224 is needed to trip the breaker than would be needed for the configuration shown in FIG. 2. Conversely, when the trip bar is moved to the farthest position out of the page, the latch surface 222*b* rests at position 610*b* of the latch surface 610. In this position, the trip bar is rotated clockwise from the position shown in FIG. 2 and the surface 222*a* of the trip bar 222 is closer to the bimetallic element 224. In this position, a slighter deflection of the bimetallic element is needed to trip the breaker than would be needed for the configuration shown in FIG. 2. Thus, by adjusting the knob which slides the latch surface 222*b* of the trip bar 222 across the latch surface 610 of the intermediate latch 128, the rating of the breaker may be adjusted. Although the above discussion concerns only the relative positions of the bimetallic strip 224 and the trip surface 222*a* of the trip bar 222, the same analysis applies for the armature (not shown) of a magnetic trip unit.

While the latch surface 610 is shown as a continuous slope, it is contemplated that it may be implemented as a series of stepped latch surfaces, each latch surface being lower than the preceding latch surface. In this alternative embodiment, the tactile field feedback from the stepping of the trip bar 222 as the latch surface 222*b* is moved across the latch surface 610 would allow the trip bar to be moved to a predetermined position on the latch surface 610. If the steps are selected to position the trip surface 222*a* a predetermined distance from the bimetallic element 224, the steps on the latch surface 610 may be used to allow the rating of the circuit breaker to be adjusted in the field.

As described above and as shown in FIG. 6A, the intermediate latch 218 includes two mounting tabs 616 each of which includes a pivot edge 616*a*. As described above with reference to FIG. 4D, the structure of the latch whereby the mounting tab is at an angle with respect to the latch surfaces allows the latch pivot to be set on the edge 616*a* of the mounting tab 616. FIG. 6B is a front plan view of the intermediate latch 218 and FIG. 6C is a side plan view of the intermediate latch. As shown in FIG. 6C, the intermediate latch 218 is generally "Z" shaped, having an upper leg, which includes the latch surface 614 and extends approximately vertically upward in the FIG. 6C. The lower leg of the "Z" shaped intermediate latch 218 includes latch surface 610 and extends approximately vertically downward from the center portion of the latch.

Thus the center portion of the latch 218, which includes the mounting tabs 616, is at an angle with respect to both the lower leg and the upper leg of the intermediate latch 218. In the exemplary embodiment of the invention, the center section of the intermediate latch 218 is at an angle of approximately 45° with respect to both the upper leg and the lower leg of the intermediate latch. This angle is only exemplary. It is contemplated that other angles may be used or that different angles may be used between the mounting tabs and the respective upper and lower legs of the intermediate latch. These angles may be optimized for a particular application.

FIG. 6B is a front plan view of the intermediate latch 218. As shown in FIG. 6B, the lower latch surface 610 defines an angle a with respect to a horizontal line parallel to the bottom edge 620 of the intermediate latch 218. In the exemplary embodiment of the invention, the angle $\alpha$ is approximately 3.5°. This angle is exemplary and other angles may be used depending on the application. In addition, as set forth above, the different latch surfaces 610 may be implemented in a stepped manner, with rounded step edges, along the bottom latch surface of the intermediate latch 218. Desirably, the width of each step latch surface is at least as wide as the width of the latch surface 222*b* on the trip bar 222.

FIGS. 6A, 6B and 6C show an additional upper latch surface 612. This latch surface is used with a second embodiment of the invention, described below with reference to FIGS. 10, 11, 12, and 13.

Figure 7A:
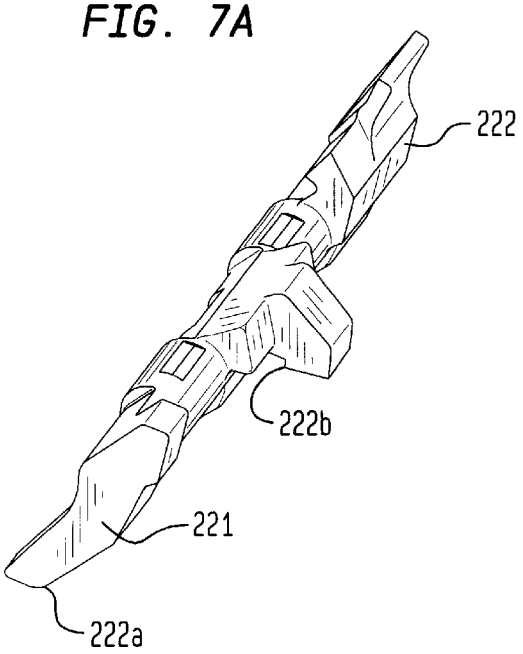
FIGS. 7A and 7B are isometric drawings which show a trip bar suitable for use with the present invention.
Figure 7B:
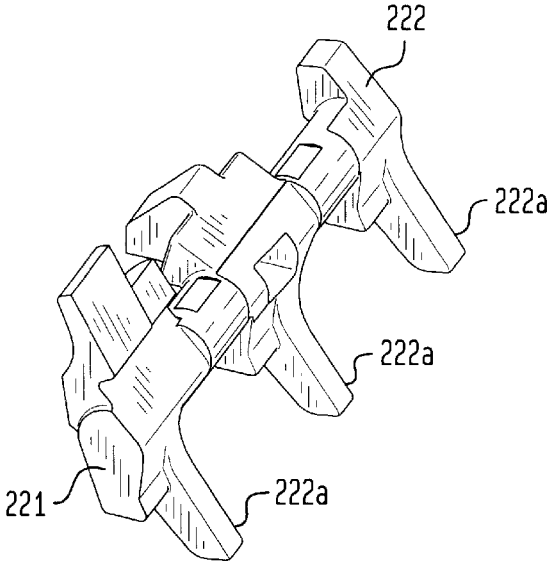

FIGS. 7A and 7B are isometric drawings of the trip bar 222. As shown in FIGS. 7A and 7B, the trip bar 222 pivots about an axis 221. The trip bar includes three trip surfaces 222*a*, one for each pole of the breaker. Each of the trip surfaces 222*a* is configured to make contact with a respective one of the bimetallic elements 224 in each pole of the breaker 100. As shown in FIG. 7A, the center pole of the trip bar 222 includes the latch surface 222*b* which engages the lower latch surface 610 of the intermediate latch 218, as described above.

As shown in FIG. 2, the intermediate latch 218 also retains the torsion spring 220 on the mounting tabs 616, between the main body of the intermediate latch 218 and the sides 310 of the mechanical frame.

Figure 8:
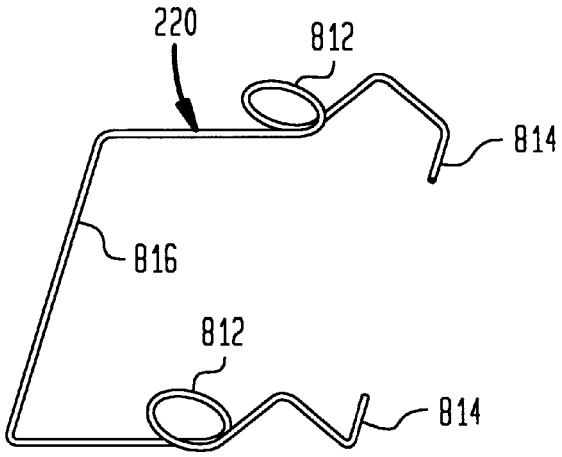
FIG. 8 is an isometric drawing of a torsion spring suitable for use with the present invention.

FIG. 8 is an isometric drawing of the torsion spring 220. As shown in FIG. 8, the spring 220 is a double spring including two spring elements 812 joined by a common back leg 816. The dual torsion spring 220 also has two front legs 814.

Figure 9:
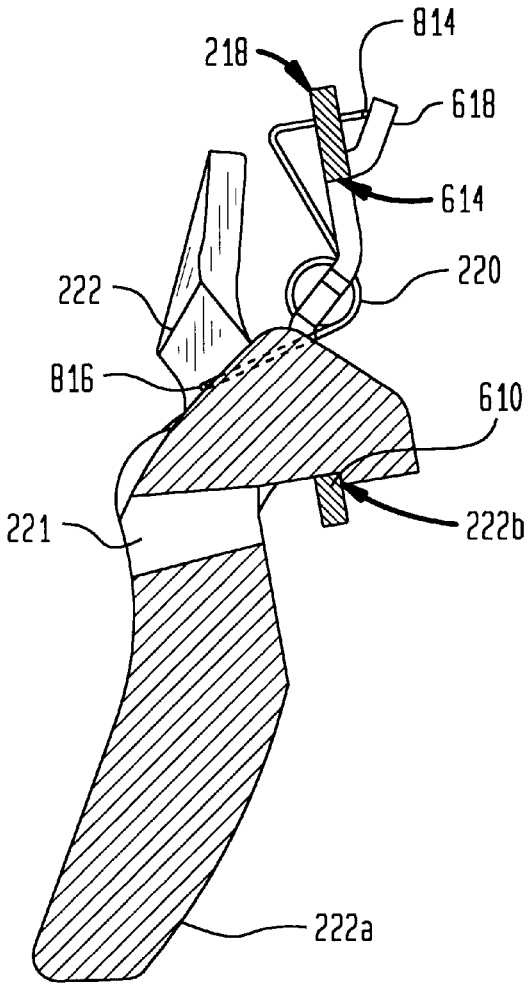
FIG. 9 is a cutaway side plan drawing which illustrates the construction of the latch mechanism used in the circuit breaker according to the present invention.

FIG. 9 is a cutaway side plan view of the trip bar 222, intermediate latch 218 and dual torsion spring 220 which illustrates the interaction among these components. As shown in FIG. 9, the back leg 816 of the dual torsion spring 220 engages an upper surface of the trip bar 222. Because the surface at which the back leg 816 engages the trip bar 222 is to the right of the pivot axis 221, as shown in FIG. 9, the torsion spring 220 biases the trip bar 222 to rotate in a clockwise direction. This causes the latch surface 222*b* of the trip bar 222 to engage the latch surface 610 of the intermediate latch 218 when the toggle handle 130 of the circuit breaker (shown in FIGS. 1 and 2) is moved from the open position to the closed position.

In addition to biasing the trip bar 222, the torsion spring 220 also biases the intermediate latch 218 to engage the latch surface 216*a* of the cradle 216 when the circuit breaker is closed. As shown in FIG. 9, the front legs 814 of the torsion spring 220 engage the tabs 618 which extend from the upper portion of the intermediate latch 218. The force applied by the torsion spring 220 to the tabs 618 tends to rotate the intermediate latch 218 in a clockwise direction. When the toggle handle 130 is moved from the tripped position to the reset position, the cradle 216 rotates in a counterclockwise direction and, as it passes below the latch surface 614, the torsion spring 220 biases the latch surface 614 of the intermediate latch 218 to engage the latch surface 216*a* of the cradle 216.

The force exerted by the torsion spring 220 on the intermediate latch 218 is negligible in comparison to the force exerted on the latch surface 614 by the cradle 216 and tension spring 242 (shown in FIG. 2). When the circuit breaker is tripped and the trip bar 222 rotates in a counterclockwise direction it releases the latch surface 610 of the intermediate latch 218 from the latch surface 222*b* of the trip bar 222. The force exerted by the latch surface 216*a* of the cradle 216 immediately causes the intermediate latch 218 to rotate in a counterclockwise direction, opposing the negligible force exerted by the biasing spring 220.

Figure 10:
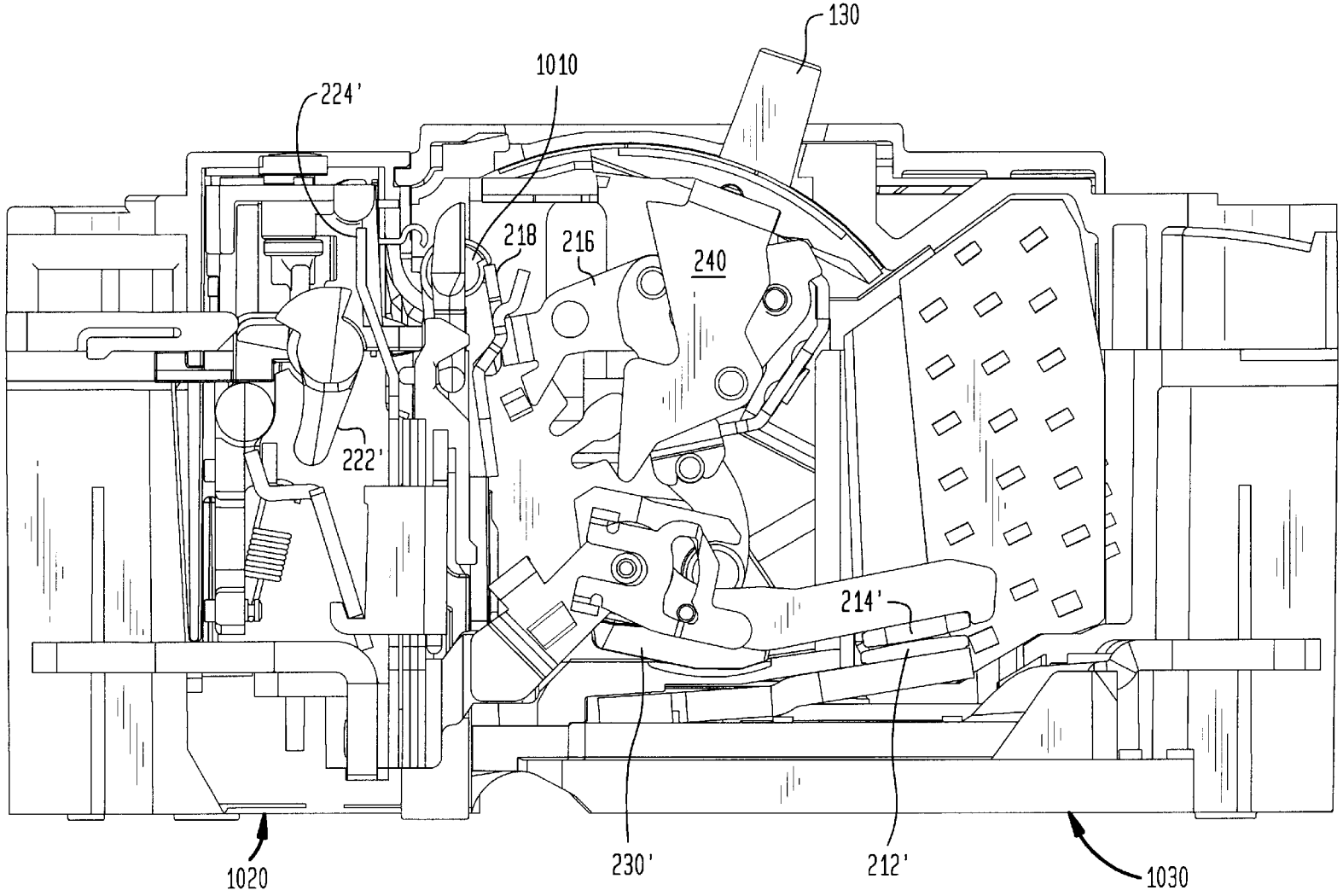
FIG. 10 is a cutaway side plan view of an alternative circuit breaker which also uses the intermediate latch structure shown in FIGS. 6A through 6C.

FIG. 10 is a cutaway side plan view of a second exemplary circuit breaker which uses the intermediate latch 218 but in a different structure. The circuit breaker shown in FIG. 10 includes a separate switch unit 1030 and trip unit 1020. The trip unit 1020 includes a bimetallic element 224' which engages a trip bar 222' which is entirely within the trip unit 1020. The trip bar 222', when engaged, rotates in a counterclockwise direction releasing a latch kicker 1110 (shown in FIGS. 11 and 13) to transmit the trip indication to the switch unit 1030. When the trip unit is connected to the switch unit, the latch kicker 1110 engages an intermediate latch bar 1010 in the switch unit 1030. When the latch bar 1010 is engaged by the latch kicker 1110, it rotates in a counterclockwise direction releasing the latch surface 612 of the intermediate latch 218.

In this second embodiment of the invention, when this upper latch surface 614 is released, the intermediate latch 218 is free to pivot on the pivot axis defined by the pivot edge 616*a* in a counterclockwise direction, to release the cradle 216 from the latch surface 614 of the intermediate latch 128. The operation of the cradle 216 and operating mechanism 240 of the circuit breaker shown in FIG. 10 is essentially the same as the operation of the corresponding components described above with reference to FIGS. 2 through 9. As the cradle 216 rotates in a clockwise direction, the operating mechanism 240 causes the crossbar 230 to rotate in a counterclockwise direction pulling the load contact arm 214 away from the line contact arm 212, thus opening the circuit breaker.

Figure 11:
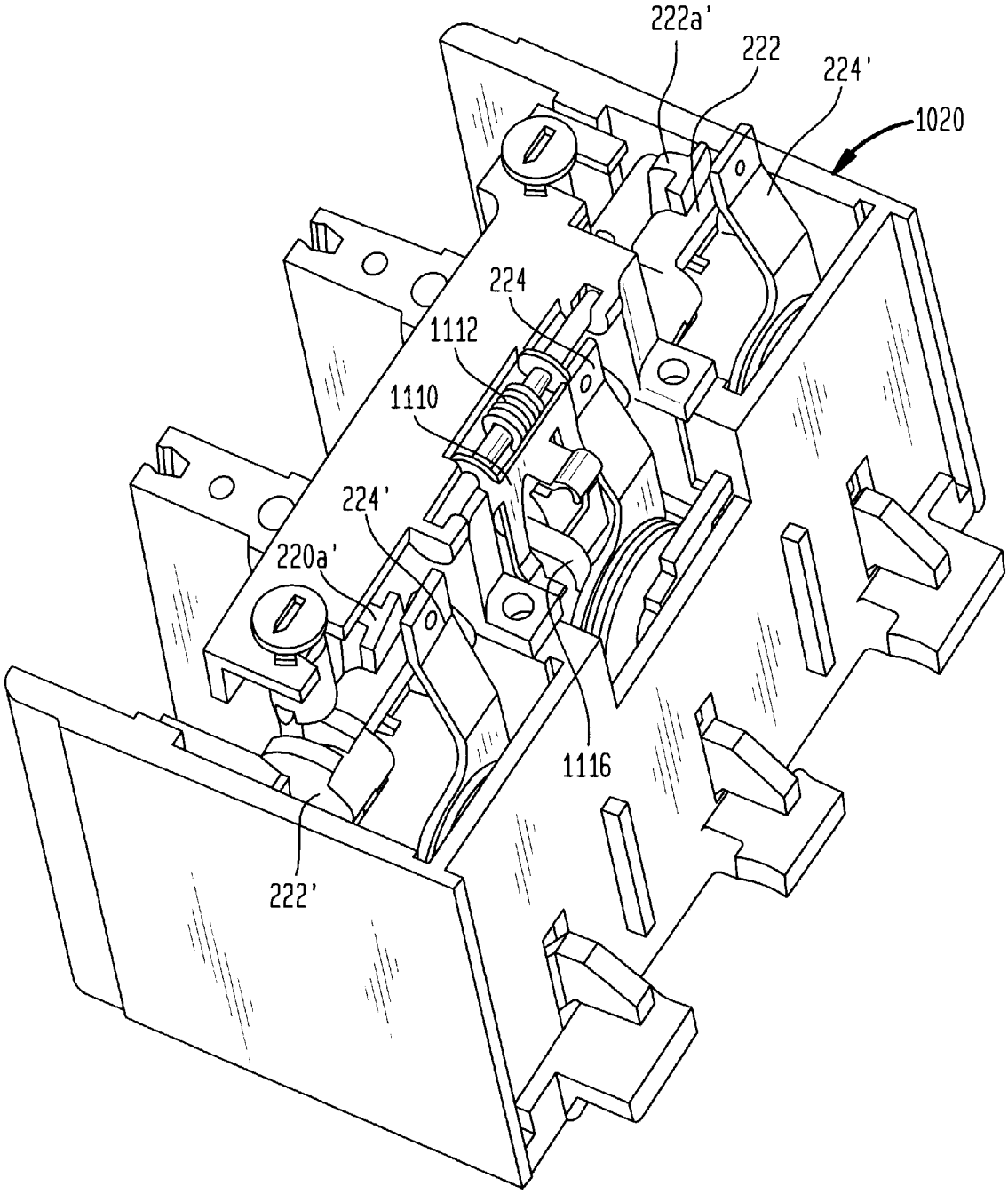
FIG. 11 is an isometric drawing of the trip unit of the molded case circuit breaker shown in FIG. 10.

FIG. 11 is an isometric drawing of the trip unit 1020 of the circuit breaker shown in FIG. 10. As shown in FIG. 11, the trip unit 1020 includes three bimetallic elements 224' each of which engages a respective surface 222*a'* of a trip bar 222'. When one of the bimetallic elements 224' moves to engage the respective trip surface 222*a'*, the trip bar 222' rotates in a counterclockwise direction. As the trip bar rotates, a latch 1116 disengages from a latch surface on a latch kicker 1110. As the latch kicker 1110 is disengaged, a torsion spring 1112 causes the kicker 1110 to rotate counterclockwise about an axis which extends through the torsion spring. As described above with reference to FIG. 10, when the latch kicker 1110 is released, it engages a foot 1210 (shown in FIG. 12A) of the intermediate latch bar 1010.

Figure 12A:
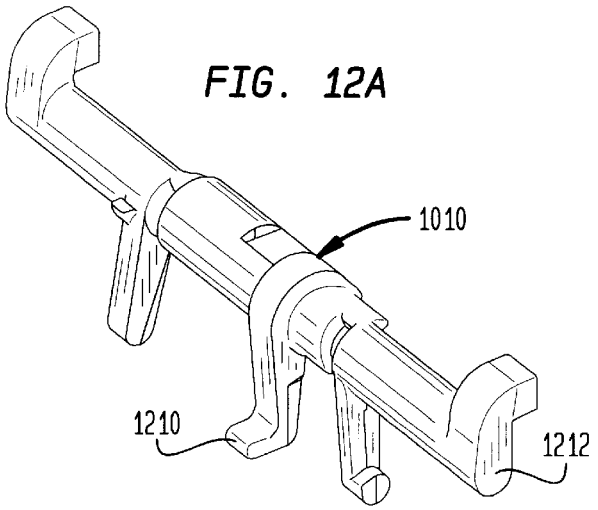
FIG. 12A is an isometric drawing of an intermediate latch bar suitable for use with the circuit breaker shown in FIG. 10.
Figure 12B:
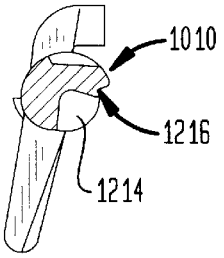
FIG. 12B is a cutaway drawing of the intermediate latch bar along lines 12B—12B shown in FIG. 12A, which is useful for describing the operation of the latch mechanism of the circuit breaker shown in FIG. 10.

FIG. 12A is an isometric drawing of the intermediate latch bar 1010. As shown in FIG. 12A, the intermediate latch bar pivots about and axis 1212. FIG. 12B is a cutaway side plan view of the intermediate latch bar 1010 taken along the lines 12B—12B shown in FIGS. 12A and 12C. As shown in FIG. 12B, the intermediate latch bar 1010 includes a latch surface 1216 which engages the latch surface 612 of the intermediate latch 218 which, using the latch surface 614, engages the latch surface 216*a* of the cradle 216 (shown in FIG. 3). The intermediate latch bar 1010 includes a void 1214 which opens beneath the latch surface 1216. When the intermediate latch bar 1010 rotates in a counterclockwise direction, the latch surface 1216 of the intermediate latch bar 1010 disengages from the latch surface 612 of the intermediate latch 218. The intermediate latch 218 responsive to the force exerted by the latch surface 216*a* of the cradle 216, on the latch surface 614 rotates about the pivot edge 616*a* in a counterclockwise direction in to the void 1214 of the latch bar 1010.

Figure 12C:
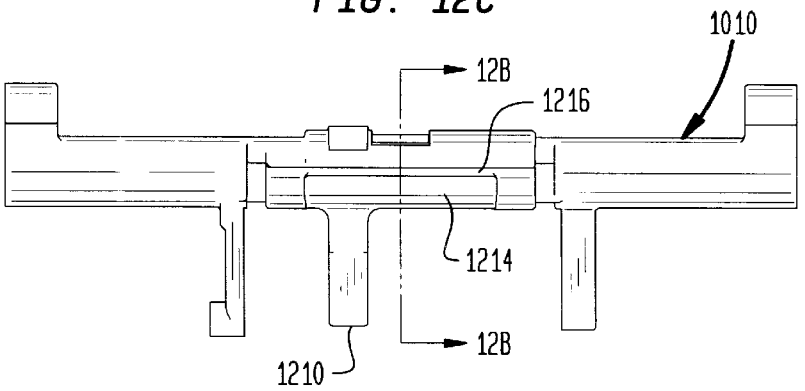
FIGS. 12C and 12D, respectively, are a side plan view and a top plan view of the intermediate latch bar shown in FIGS. 12A and 12B.
Figure 12D:
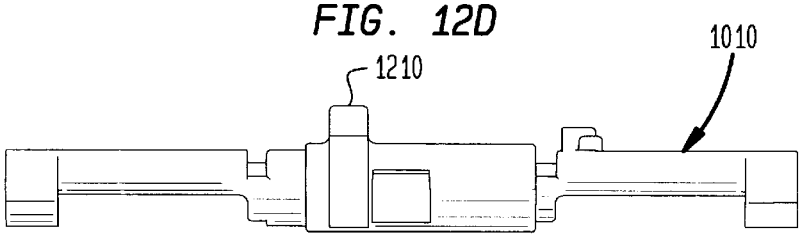

As the intermediate latch 218 rotates in a counterclockwise direction, the latch surface 216*a* of the cradle unit 216 is released and the cradle unit rotates in a clockwise direction, opening the breaker contacts as described above. FIGS. 12C and 12D are, respectively, a front plan view and a top plan view of the intermediate latch bar 1010. FIG. 12C shows the latch surface 1216 extending along the center pole portion of the intermediate latch bar 1010. Immediately below the latch surface 1216, is the void 1214 into which the intermediate latch 218 is released by the rotation of the intermediate latch bar 1010.

Figure 13:
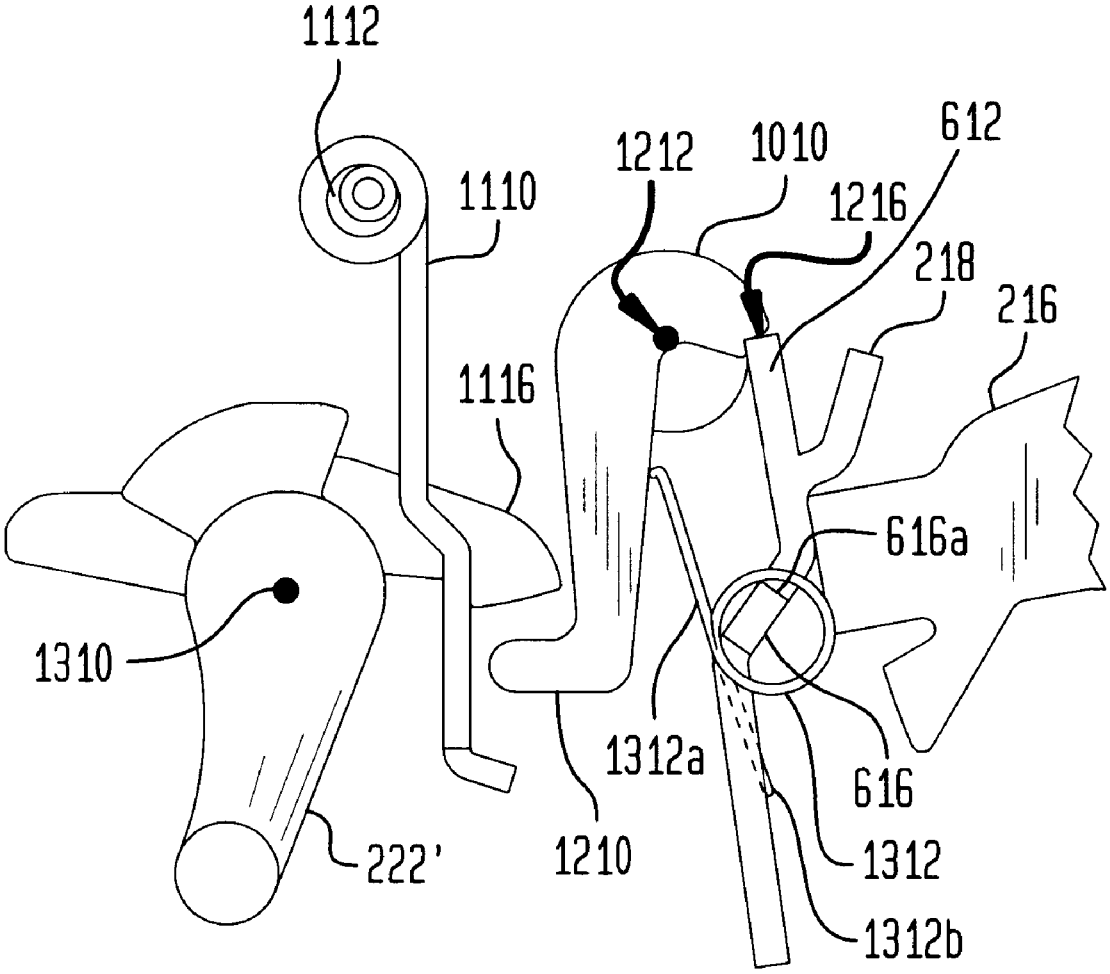
FIG. 13 is a partial cutaway side plan view of the circuit breaker shown in FIG. 10 which is useful for describing the operation of the latch mechanism of the circuit breaker.

FIG. 13 is a cutaway view of selected components of the circuit breaker shown in FIG. 10 which is useful for describing the operation of the tripping mechanism.

When the circuit breaker is tripped either the bimetallic strip (not shown in FIG. 13) or the magnetic armature (not shown in FIG. 13) engages the trip bar 222' and cause it to rotate in a counterclockwise direction. As trip bar 222' rotates in a counterclockwise direction, it rotates the latch 1116 upward releasing the latch kicker 1110. The latch kicker 1110 under the torsion force exerted by the spring 1112 rotates in a counterclockwise direction engaging the foot 1210 of the intermediate latch bar 1010. When the latch kicker 1110 engages the foot 1210, the intermediate latch bar 1010 rotates in a counterclockwise direction, disengaging the latch surface 1216 on the intermediate latch bar from the latch surface 612 on the intermediate latch 218 and moving the void 1214 into a position in which the latch 218 may rotate counterclockwise into the void. As the intermediate latch bar 1010 continues to rotate in a counterclockwise direction, the intermediate latch 218 rotates counterclockwise into the void 1214 and disengages latch surface 614 (not shown in FIG. 13) of the intermediate latch 218 from latch surface 216*a* (not shown in FIG. 13) of the cradle 216. This allows the cradle 216 to rotate in a clockwise direction, allowing the contact arms 214' and 212' to open as described above.

As shown in FIG. 13, the intermediate latch 218 includes mounting tabs 616 as shown in FIG. 6A. The mounting tabs 616 define a pivot edge 616*a* which, as described above, is accurately positioned within the sides 310 of the mechanical frame that supports the components of the operating mechanism 240.

FIG. 13 also shows a torsion spring 1312 which is retained between the main body of the intermediate latch 218 and the sides 310 of the mechanical frame by the mounting tabs 616 of the intermediate latch 218. The torsion spring 1312 includes a first arm 1312*a* which engages the intermediate latch bar 1010 as shown in FIG. 13 and biases the latch bar 1010 for rotation in a clockwise direction. This biasing force biases the intermediate latch bar 1010 to engage its latch surface 1216 with the latch surface 612 of the intermediate latch 218. The biasing spring 1312 also biases the intermediate latch bar 1010 to place the trip foot 1210 proximate to the latch kicker 1110. The torsion spring 1312 includes a second arm 1312*b*, which engages the intermediate latch 218 and biases the intermediate latch for rotation in a clockwise direction. This biasing force of the spring 1312 biases the latch surface 614 of the intermediate latch 218 to engage the latch surface 216*a* of the cradle 216.

Because the intermediate latch bar 1010 is not itself the trip bar, there is no need for an adjustment mechanism as described above with respect to the slanted latch surface 610 of the intermediate latch 218. Indeed, in the embodiment of the invention shown in FIGS. 10 through 13, the lower latch surface 610 of the intermediate latch 218 is not used. It is contemplated, however, that in an alternative configuration, the upper latch surface 612 may engage a trip bar rather than the intermediate latch bar shown in FIGS. 10 through 13. In this instance, the upper latch surface 612 may be sloped along its long dimension to allow the trip range of the circuit breaker to be adjusted in the field.

The subject invention concerns an operating mechanism for a circuit breaker which has a multi-functioned intermediate latch that both simplifies the design of the circuit breaker and makes its operation more accurate. While the invention has been described in terms of exemplary embodiment, it is contemplated that it may be practiced as outlined above within the scope of the appended claims.

What is claimed:

1. An electrical circuit breaker comprising:

first and second electrical contacts;

a trip mechanism including a trip bar, which trip mechanism is responsive to an overcurrent condition in the circuit breaker to cause the trip bar to move;

an operating mechanism, configured to move the first and second electrical contacts into an open position and into a closed position;

a latch including a latch surface which is configured to latch the operating mechanism, the latch being responsive to the movement of the trip bar to unlatch the operating mechanism, wherein the latch has an upper portion, a lower portion and an angled pivot portion which connects the upper portion to the lower portion, the pivot portion of the latch including first and second mounting tabs and being configured at an angle to at least one of the upper portion and the lower portion, the angle defining a pivot edge on the first and second mounting tabs on which the latch pivots; and a mechanical frame having first and second sides, each of the first and second sides including an aperture which defines a pivot point, whereby the first and second mounting tabs are inserted into the respective apertures of the first and second sides of the mechanical frame such that the pivot edge of each mounting tab rests at the pivot point of the respective aperture.

2. A circuit breaker according to claim 1, wherein the latch is generally "Z" shaped and the upper portion, lower portion and pivot portion of the latch are each substantially planar and pivot portion of the latch defines an angle of approximately 45° with respect to each of the upper portion and the lower portion.

3. A circuit breaker according to claim 2, wherein the mounting tabs of the pivot portion of the latch have a substantially rectangular cross section and the pivot edge corresponds to one corner of the rectangular cross section.

4. A circuit breaker according to claim 1, further including a biasing spring configured to be retained in the mechanical frame by the mounting tabs of the latch, the biasing spring being mechanically coupled to the latch to bias the latch toward the operating mechanism to cause the latch to engage the operating mechanism when the operating mechanism moves the first and second electrical contacts from the open position to the closed position.

5. A circuit breaker according to claim 4, wherein:

the trip bar includes a latch surface;

the operating mechanism includes a cradle having a latch surface;

the upper portion of the latch includes an upper latch surface which engages the latch surface of the cradle and the lower portion of the latch includes a lower latch surface which engages the trip bar; and the biasing spring includes a first end which is mechanically coupled to the upper portion of the latch to bias the upper latch surface towards the latch surface of the cradle and a second end which is mechanically coupled to the trip bar to bias the latch surface of the trip bar toward the lower latch surface of the latch.

6. A circuit breaker according to claim 1, wherein:

the trip mechanism includes a bimetallic strip, configured to bend and move the trip bar on the occurrence of the overcurrent condition;

the lower portion of the latch includes a lower latch surface, the lower latch surface having a long dimension and a short dimension and exhibiting an angled slope along the long dimension;

the trip bar includes a trip surface which is configured at a distance from the bimetallic strip and which is engaged by the bimetallic strip on the occurrence of the overcurrent condition and a latch surface which engages the lower latch surface and an adjustment mechanism by which the latch surface of the trip bar is moved across the long dimension of the lower latch surface, causing the trip bar to change the distance between the trip surface and the bimetallic strip to thereby change the overcurrent condition at which the bimetallic strip engages the trip surface.

7. A circuit breaker according to claim 1, wherein:

the circuit breaker includes a trip unit, containing the trip mechanism, which is separate from a switch unit that contains the operating mechanism;

the trip mechanism includes a latch structure which is responsive to the motion of the trip bar to transmit the motion from the trip unit to the switch unit;

the switch unit includes a latch bar having a latch surface, wherein the latch bar is responsive to the motion transmitted by the latch structure of the trip unit to exhibit motion in response to the overcurrent condition;

the operating mechanism includes a cradle having a latch surface;

the upper portion of the latch includes a first latch surface which engages the latch surface of the cradle and a second latch surface which engages the latch surface of the latch bar.

8. a circuit breaker according to claim 7, wherein the operating mechanism further includes a biasing spring which is retained to the mechanical frame by the mounting tabs of the latch, the biasing spring including a first end which is mechanically coupled to the upper portion of the latch to bias the first latch surface towards the latch surface of the cradle and a second end which is mechanically coupled to the latch bar to bias the latch surface of the latch bar toward the second latch surface of the latch.

9. An electrical circuit breaker comprising:

first and second electrical contacts;

a trip mechanism including a trip bar, the trip mechanism being responsive to an overcurrent condition in the circuit breaker to cause the trip bar to move;

an operating mechanism, configured to move the first and second electrical contacts into an open position and into a closed position;

a latch including first and second mounting tabs, a first latch surface configured to engage the operating mechanism and a second latch surface configured to engage the trip bar, the latch being responsive to the movement of the trip bar to disengage the second latch surface from the trip bar and to disengage the first latch surface from the operating mechanism; and a mechanical frame having first and second sides, each of the first and second sides including an aperture configured to accept the respective first and second mounting tabs of the latch to mount the latch into the mechanical frame; and a biasing spring configured to be retained in the mechanical frame by the mounting tabs of the latch, the biasing spring including a first end which is mechanically coupled to the latch to bias the first latch surface towards the operating mechanism and a second end which is mechanically coupled to the trip bar to bias the trip bar toward the second latch surface.

10. An electrical circuit breaker comprising:

first and second electrical contacts;

a trip mechanism including:

a bimetallic strip, configured to bend responsive to an overcurrent condition in the circuit breaker;

a trip bar, including a latch surface and a trip surface, the trip bar being mounted at a distance from the bimetallic strip such that, when the bimetallic strip bends responsive to the overcurrent condition, the bimetallic strip engages the trip surface of the trip bar, causing the trip bar to move;

an operating mechanism, configured to move the first and second electrical contacts into an open position and into a closed position;

a latch including:

a first latch surface configured to engage the operating mechanism; and a second latch surface configured to engage the latch surface of the trip bar, the second latch surface having a long dimension and a short dimension and exhibiting an angled slope along the long dimension; wherein the latch is responsive to the movement of the trip bar to disengage the second latch surface from the trip bar and to disengage the first latch surface from the operating mechanism, causing the first and second electrical contacts to move from the closed position to the open position; and an adjustment mechanism by which the latch surface of the trip bar is moved across the angled slope of the second latch surface, causing the trip bar to change the distance between the trip surface and the bimetallic strip to thereby change the overcurrent condition at which the bimetallic strip engages the trip surface.

11. An electrical circuit breaker according to claim 10, wherein the slope on the long dimension of the second latch surface includes a plurality of steps, such that, as the latch surface of the trip bar is moved across the long dimension of the second latch surface, each step defines a respective predetermined distance between the bimetallic element and the trip surface of the trip bar.

12. An electrical circuit breaker comprising:

first and second electrical contacts;

a trip mechanism including a trip bar, which trip mechanism is responsive to an overcurrent condition in the circuit breaker to cause the trip bar to move;

an operating mechanism, configured to move the first and second electrical contacts into an open position and into a closed position;

a generally "Z" shaped latch including:

a substantially planar upper portion including a first latch surface which is configured to engage the operating mechanism, a substantially planar lower portion; including a second latch surface which is configured to engage the trip bar; and a pivot portion wherein the pivot portion of the latch includes first and second mounting tabs and the pivot portion defines an angle of approximately 45° with respect to each of the upper portion and the lower portion, which angle defines a pivot edge on the first and second mounting tabs on which the latch pivots;

wherein, the latch is responsive to the movement of the trip bar to disengage the second latch surface from the trip bar and to pivot about the pivot edge to disengage the first latch surface from the operating mechanism, and a mechanical frame having first and second sides, each of the first and second sides including an aperture having two substantially straight sides which intersect to define a pivot point, whereby the first and second mounting tabs are inserted into the respective apertures of the first and second sides of the mechanical frame such that the pivot edge of each mounting tab rests at the pivot point of the respective aperture.

13. An electrical circuit breaker according to claim 12, wherein the operating mechanism further includes a biasing spring configured to be retained in the mechanical frame by the mounting tabs of the latch, the biasing spring being mechanically coupled to the latch to bias the latch toward the operating mechanism to cause the latch to engage the operating mechanism when the operating mechanism moves the first and second electrical contacts from the open position to the closed position.

14. A circuit breaker according to claim 13, wherein:

the trip bar includes a latch surface;

the operating mechanism includes a cradle having a latch surface;

the first latch surface of the latch engages the latch surface of the cradle and the second latch surface of the latch engages the latch surface of the trip bar; and the biasing spring includes a first end which is mechanically coupled to the latch to bias the first latch surface towards the latch surface of the cradle and a second end which is mechanically coupled to the trip bar to bias the latch surface of the trip bar toward the second latch surface of the latch.

* * * * *